United States Patent [19]

Haas et al.

[11] 4,243,639

[45] Jan. 6, 1981

[54] METHOD FOR RECOVERING VANADIUM FROM PETROLEUM COKE

[75] Inventors: Frank C. Haas, Arvada; William K. Hesse, Boulder, both of Colo.

[73] Assignee: Tosco Corporation, Los Angeles, Calif.

[21] Appl. No.: 37,493

[22] Filed: May 10, 1979

[51] Int. Cl.[3] ..... C01G 31/00

[52] U.S. Cl. ..... 423/63; 423/64; 423/65; 423/68

[58] Field of Search ..... 423/63, 64, 65, 68, 423/62

[56] References Cited

U.S. PATENT DOCUMENTS

| | | | |
|---|---|---|---|
| 2,372,109 | 3/1945 | Noel | 423/64 |
| 3,615,299 | 10/1971 | Flecher et al. | 423/62 |
| 3,615,300 | 10/1971 | Helm et al. | 423/62 |
| 3,773,890 | 11/1973 | Fox et al. | 423/68 |
| 4,087,510 | 5/1978 | Steenken | 423/68 |
| 4,145,397 | 3/1979 | Toida et al. | 423/63 |

FOREIGN PATENT DOCUMENTS

| | | | |
|---|---|---|---|
| 245763 | 8/1962 | Australia | 423/64 |
| 44-10897 | 5/1969 | Japan | 423/68 |

*Primary Examiner*—Herbert T. Carter

*Attorney, Agent, or Firm*—Poms, Smith, Lande & Rose

[57] ABSTRACT

Petroleum coke containing inorganic compounds including vanadium is gasified with steam in the presence of an alkali metal salt gasification catalyst to produce a combustible gas and an inorganic ash composed primarily of said inorganic compounds and a water soluble alkali metal vanadate and the inorganic ash is placed in a sufficient amount of water to dissolve the vanadate compound and then is recovered by conventional means.

11 Claims, No Drawings

METHOD FOR RECOVERING VANADIUM FROM PETROLEUM COKE

BACKGROUND OF THE INVENTION

During the processing of crude oil by refineries relatively large amounts of energy are required. In addition, a relatively large amount of petroleum coke is produced which contains inorganic compounds which, depending upon the crude oil from which the coke is produced, contains a relatively large percentage of vanadium.

In order to supply a portion of the energy required by the petroleum refineries it has been suggested to gasify the carbon contained in the petroleum coke with steam to produce a combustible gas. Sometimes this gasification reaction is conducted in the present of a gasification catalyst such as an alkali metal salt in order to, inter alia, reduce the steam gasification temperature.

It is also known that vanadium, which is very valuable, can be recovered from the ashes of crude oil and/or petroleum coke. However, such recovery of the vanadium is usually conducted using sulfuric acid to leach the vanadium compounds from the ashes which is relatively expensive and also requires special processing techniques.

It would be very desirable if a process could be developed wherein petroleum coke is gasified to produce a valuable combustible gas and, at the same time, the vanadium contained in said coke is recovered in the resulting inorganic ash by an economical and simple manner.

It is therefore an object of the present invention to gasify petroleum coke with steam, in the presence of an alkali metal gasification catalyst, and recovery the vanadium contained in the resulting inorganic ash by the simple and inexpensive expedient of leaching said inorganic ash in water.

Still a further object of the present invention is to provide a process wherein, during the gasification of carbon with steam in the presence of an alkali metal salt gasification catalyst, there is produced a water soluble vanadate compound which can be separated from a substantial portion of the inorganic ash by placing the inorganic ash in a sufficient amount of water to dissolve the water soluble vanadate compound.

Other objects of the present invention will become apparent from the following detailed description.

SUMMARY OF THE INVENTION

The accomplishment of the foregoing objects and others is predicated upon the surprising discovery that during the gasification of petroleum coke with steam and in the presence of an alkali metal salt gasification catalyst there is formed, in situ, a water soluble alkali metal vanadate which may be leached from the inorganic ash produced during the gasification reaction from the inorganic compounds contained in the petroleum coke by the simple expedient of leaching the inorganic ash in a sufficient amount of water to dissolve the water soluble alkali metal vanadate compound.

The water soluble vanadate compound may be recovered by filtering the aqueous solution of vanadate compound to remove the undissolved inorganic ash and then either precipitating out the vanadate compound by, for example, reducing the pH of the aqueous solution to about 2 or less or, alternatively, merely evaporating the water whereby the vanadate compound can easily be recovered.

DESCRIPTION OF THE PREFERRED EMBODIMENTS

We have found that when using an alkali metal salt gasification catalyst during the gasification of petroleum coke with steam, the temperature at which the gasification reaction takes place and produces a combustible gas will also produce a water soluble alkali metal vanadate. Surprisingly, temperatures and pressures of the gasification reaction are not critical nor is the amount of catalyst present in the reaction mixture critical.

For example, temperatures in excess of about 1000° F. will produce the water soluble vanadate. However, in general, for economical reasons we prefer to utilize gasification temperatures of between about 1000° F. and about 1500° F. or 2000° F. because, when using the gasification catalyst, the gasification reaction proceeds sufficiently rapidly.

The amount of gasification catalyst used is not particularly critical providing that at least the same weight amount of catalyst is present in the gasification mixture as there is vanadium compounds in the petroleum coke. We have found that, in general, the catalyst may be present in an amount from about 1 weight % to about 50 weight %, based on the total weight of the petroleum coke and catalyst, and more preferably from about 4 or 5 weight % to about 40 or 50 weight %.

Insofar as we are aware, all alkali metal salt gasification catalysts will form a water soluble alkali metal vanadate at temperatures and pressures under which the gasification of carbon with steam will occur. In this regard, it should be noted that pressures are not at all critical and one may operate from ambient pressures to pressures in excess of 2000 lbs. per square inch gauge (psig). However, since the gasification reaction is preferably conducted in a fluidized bed gasification zone and since such fluidization requires a minimum amount of pressure, for example, 10 or 20 psig, it may be said that we prefer to operate the gasification reaction at a pressure of about 10 or 20 psig to as high as 1000 or 2000 psig. Since we have found no economic advantage in operating at high pressures there is no apparent reason to use pressures in excess of 200 or 300 psig during the gasification reaction.

As noted, all alkali metal salt gasification catalysts will form a water soluble alkali metal vanadate at temperatures and pressures which will gasify the carbon in the petroleum coke with steam. Since these alkali metal salt gasification catalysts are relatively well known in the art no detailed exemplification thereof will be given herein but such alkali metal salt gasification catalysts which may be mentioned as being operable are the carbonate, the sulfide, the sulfate, the hydroxide and the oxide salts of the alkali metals, the preferred alkali metal being either potassium or sodium and the most preferred catalyst being either potassium carbonate or sodium carbonate.

The petroleum coke, in general, will contain from about 0.1 weight % to about 5 weight % of inorganic compounds, including vanadium, and more generally, from about 0.5 weight % to 2 or 3 weight % inorganic compounds. During gasification of the petroleum coke the carbon contained in the coke is gasified with steam and there will remain as solid particles inorganic ash primarily composed of said inorganic compounds and the water soluble alkali metal vanadate. In addition, some of the solid particles will contain unreacted carbon; however, the water soluble alkali metal vanadate may be leached from the inorganic ash containing carbon as easily and expediently and in the same manner as the water soluble alkali metal vanadate is leached from inorganic ash not containing carbon. In this regard, it is noted that the carbon may be burned off of the inorganic ash prior to leaching but this is not necessary nor desirable since merely adding the inorganic ash containing organic carbon to water will leach the water soluble vanadate from the remaining part of the inorganic has, although in certain instances there may be a minor amount of other water soluble compounds in the inorganic ash which will be leached out in conjunction with the water soluble vanadate.

In this respect, it should be noted that temperature of the leach water is not important since the water soluble alkali metal vanadate is very soluble in water. In general the temperature of the leach water may range from about ambient (about 70° F.) to boiling with the preferred range being about 80° F. or 100° F. to about 200° F.

In addition, the inorganic ash may also contain a certain amount of gasification catalyst. A number of the gasification catalysts used in the present invention are also water soluble and therefore will be leached from the inorganic ash with the water soluble vanadate. If this occurs and it is desired to separate the water soluble vanadate from the other water soluble compounds in the inorganic ash the water soluble vanadate may be selectively extracted from the aqueous solution by means known in the art. For example, the water soluble vanadate may be recovered from said aqueous solution by dissolving an extracting agent for the vanadate in an organic solvent for the extracting agent thereby forming a vanadium rich organic solution which is separated from the water. For example, if the organic solvent is water immiscible it will form a separate layer which can easily be separated from the water and, the vanadium can be stripped from the vanadium rich organic solution by contacting said solution with ammonium chloride or sodium carbonate. Vanadium is then precipitated from the stripped solution by the addition of ammonia to form ammonium meta-vanadate which may be sold as such or calcined to vanadium pentoxide.

Although the term "vanadium extracting agent" is an art recognized term and the extracting agents for vanadium are known in the art, the preferred extracting agent are, if the aqueous solution is basic which it normally is, tertiary or quaternery amines and more preferably aliphatic amines, and even more preferably those tertiary and quaternery amines wherein the aliphatic group contains from about 6 to 20 carbon atoms. A preferred tertiary amine is a straight chain saturated tertiary amine wherein the aliphatic group is a mixture of carbon chains having 8 carbons to 10 carbons with the 8 carbon chain predominating. This tertiary amine is sold under the trademark Alamine 336 by General Mills, Inc..

A preferred quaternery amine is tri-caprylyl methyl ammonium chloride which is sold under the trademark Aliquat 336 sold by General Mills, Inc..

Both of these amines may be dissolved in any suitable organic solvent therefor, the preferred solvent being kerosene which is water immiscible.

If the aqueous solution is acidic, which is normally not the case, excellent vanadium extracting agents are aliphatic esters of phosphoric acid and preferably lower aliphatic esters (e.g. lower alkyl esters) such as di-(2-ethyl hexyl) phosphoric acid.

As noted before, the use of vanadium extracting compounds, dissolved in a suitable organic solvent therefor, are used only when the inorganic ash contains other water soluble compounds which amount to more than about 25 weight % based on the total weight of water soluble vanadate and other water soluble inorganic compounds. Such is often the case when the alkali metal salt gasification catalyst is water soluble as, for example, when using either potassium or sodium carbonate. In such instances, Alamine 336 is dissolved in kerosene and added to the aqueous solution containing the water soluble vanadate. The amount of Alamine 336 added to the aqueous solution is in stoichiometric excess of the water soluble vanadate contained in said aqueous solution.

The organic solution is separated from the aqueous solution and to the vanadium-rich organic solution is added an aqueous solution of ammonium chloride, sodium carbonate, etc. The vanadium is then precipitated from the stripped solution by the addition of ammonia to form ammonium meta-vanadate which can be sold as such or, as has been noted above, may be calcined to vanadium pentoxide.

However, oftentimes it will not be necessary to extract the vanadium from the aqueous solution by utilizing a vanadium extracting agent. Those instances occur when the inorganic ash contains relatively small amounts of other water soluble inorganic compounds. Under such conditions the alkali metal vanadate compound is easily precipitated from the aqueous solution by the addition of a strong mineral acid such as sulfuric or hydrochloric to reduce the pH of the solution to less than about 2 at which point the alkali metal vanadate comes out of solution and may easily be removed therefrom by means known in the art such as filtration.

EXAMPLE 1

In this example, petroleum fluid coke was used which contained about 0.5 to about 1 weight % of inorganic compounds, the remainder of the coke being carbon. To the petroleum coke was added between about 4 and 8 weight % of potassium carbonate and the mixture was fluidized in a fluidized gasification zone by injecting a mixture of steam and oxygen in the bottom of the zone in an amount sufficient to fluidize the mixture of coke and catalyst. The temperature in the fluidized gasification zone was maintained at between about 1200° and 1400° F. through the exothermic reaction between oxygen and carbon. The amount of steam injected was between about 0.2 and 0.4 lbs. per hour per 1 lb. of carbon contained in the petroleum coke. Under such conditions a combustible gas was formed containing entrained solid particles composed primarily of inorganic ash (which may also contain some unreacted carbon) and some potassium carbonate catalyst.

The entrained particles in the combustible gas were removed from the gas by well-known means in the art such as cyclones. The separated particles were burned to remove the residual carbon which amounted to approximately 85 weight % of the total. The remaining 15 weight % of inorganic ash was leached with water having a temperature of about 100° F. Before leaching the ash contained approximately 1.89% vanadium ($V_2O_5$) and after leaching the ash only contained 0.04 weight % vanadium. Thus, the amount of vanadium extracted with water was 98% of the original amount present.

EXAMPLE 2

This example was conducted identical to the one above except that sodium carbonate was used instead of potassium carbonate and instead of potassium vanadate being formed, water soluble sodium vanadate was formed. The solid inorganic ash particles entrained in the combustible gas were removed and they contained approximately 85 weight % carbon and 15 weight % inorganic ash. The inorganic ash contained about 2 weight % vanadium ($V_2O_5$). The inorganic ash was leached with hot water (about 100° F.) and the insoluble solids filtered out.

The aqueous solution contained mostly dissolved vanadate and sodium carbonate. The vanadate was removed by adding a kerosene solution of Alamine 336 to the aqueous solution which extracted substantially all of the vanadium. To the organic solution was added an aqueous solution of sodium carbonate and the vanadium precipitate by addition of ammonia. Ammonium metavanadate was recovered in an amount exceeding 99% of that contained in the inorganic ash.

We claim:

1. A method for recovering at least about 70 weight % of the vanadium contained in petroleum coke which comprises:

heating a mixture of petroleum coke containing inorganic compounds including vanadium and an alkali metal salt gasification catalyst in the presence of steam at a sufficient temperature to gasify the carbon in the coke with said steam and produce a combustible gas and inorganic ash composed predominantly of said inorganic compounds and a water soluble alkali metal vanadate, adding said inorganic ash to water to dissolve said water soluble alkali metal vanadate and recovering said dissolved vanadate from said water.

2. A method according to claim 1 wherein said petroleum coke contains about 0.5 weight % to about 2 weight % of inorganic compounds.

3. A method according to claim 1 wherein said inorganic ash also contains unreacted carbon.

4. A method according to claim 1 wherein said mixture of said coke and said catalyst is fluidized, in a fluidized gasification zone, in the presence of steam thereby forming a combustible gas containing entrained solids of said inorganic ash.

5. A method according to claim 1 wherein the gasification temperature is between about 1000° F. and 2000° F.

6. A method according to claim 1 wherein said catalyst is a member selected from the group consisting of the carbonate, the sulfide, the sulfate, the hydroxide and the oxide salt of an alkali metal.

7. A method according to claim 6 wherein the alkali metal is selected from the group consisting of potassium and sodium.

8. A method according to claim 1 wherein the catalyst is a member selected from the group consisting of potassium carbonate and sodium carbonate.

9. A method according to claim 1 wherein the amount of catalyst in said mixture of said coke and said catalyst is between about 1 weight % and 50 weight %.

10. A method according to claim 1 wherein said inorganic ash contains water soluble compounds other than vanadate which amount to more than about 25 weight percent based on the total weight of water soluble inorganic compounds and wherein the vanadate is recovered from said water by dissolving a vanadium extracting agent in an organic solvent therefor and separating said organic solvent containing dissolved extracted vanadate therein and recovering the vanadate from the organic solvent by precipitating said vanadate from said solvent.

11. A method according to claim 10 wherein the vanadium extracting agent is a tertiary or quaternary amine.

* * * * *

UNITED STATES PATENT AND TRADEMARK OFFICE

CERTIFICATE OF CORRECTION

PATENT NO. : 4,243,639

DATED : January 6, 1981

INVENTOR(S) : Frank C. Haas and William K. Hesse

It is certified that error appears in the above—identified patent and that said Letters Patent is hereby corrected as shown below:

Column 3, line 12, change the word "has" to --ash--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*